US006217652B1

(12) United States Patent
Okubo et al.

(10) Patent No.: US 6,217,652 B1
(45) Date of Patent: Apr. 17, 2001

(54) COATING EQUIPMENT

(75) Inventors: Masaru Okubo, Toyota; Tetsuya Yoshida, Nishikamo-gun, both of (JP)

(73) Assignee: Trinity Industrial Corporation

( * ) Notice: Subject to any disclaimer, the term of this patent is extended or adjusted under 35 U.S.C. 154(b) by 0 days.

(21) Appl. No.: 09/194,573

(22) PCT Filed: Mar. 4, 1998

(86) PCT No.: PCT/JP98/00889

§ 371 Date: Nov. 27, 1998

§ 102(e) Date: Nov. 27, 1998

(87) PCT Pub. No.: WO99/44751

PCT Pub. Date: Sep. 10, 1999

(51) Int. Cl.[7] ..... B05C 11/00
(52) U.S. Cl. ..... 118/66; 118/426
(58) Field of Search ..... 118/66, 423, 426, 118/622

(56) References Cited

FOREIGN PATENT DOCUMENTS 61-183010 * 8/1986 (JP) .
4-114769 * 4/1992 (JP) .
4-354633 * 12/1992 (JP) .
10-71356 * 3/1998 (JP) .

* cited by examiner

*Primary Examiner*—Brenda A. Lamb
(74) *Attorney, Agent, or Firm*—Pillsbury Winthrop LLP

(57) ABSTRACT

A coating facility of reducing storage spaces and equipments upon storing works thereby decreasing the installation cost. During operation of conveying lines between each of steps, works W conveyed from a preceding step are loaded to hangers H of an overhead conveyor 2 at a loading position $P_1$, applied with pretreatment and coating, transferred at a transferring position $P_2$ to carriers T of a floor conveyor 9, dried and then re-transferred again at a re-transferring position $P_3$ to the overhead conveyor 2, down loaded from the hangers H at an unloading position $P_4$ and conveyed to a succeeding step. When conveying lines between each of the steps are stopped, pretreatment, coating and drying are completed for all the works W during conveyance in each of the conveyors 2 and 9, and a predetermined number of preceding works W are stored in a first storage track 13 being suspended from the hangers H of the overhead conveyor 2, while the succeeding works W are stored in a second storage track 14 being loaded as they are on the carriers of the floor conveyor 9.

2 Claims, 6 Drawing Sheets

COATING EQUIPMENT

TECHNICAL FIELD OF THE INVENTION

The present invention concerns a coating facility adapted for applying pretreatment and coating to works such as car bodies while conveying them by an overhead conveyor, then transferring them to a floor conveyor, drying and then conveying them to a succeeding step after completion of the drying.

BACKGROUND ART

FIG. 5 and FIG. 6 show a running state and a storage state of an existent coating facility for conducting electrodeposition coating which comprises, along an overhead conveyor 42 formed in a circulation track 41, a loading device 43 for loading works W conveyed from the preceding step to hangers H each at a predetermined loading position $P_1$, a pretreatment device 44 for applying pretreatment such as cleaning, degreasing and chemical formation to the surface of the works W loaded by the loading device 43, an electrodeposition coating device 45 for forming an electrodeposition coating film on the surface of the works W completed with the pretreatment by the pretreatment device 44, and a transfer device 48 for down loading the works W from the hangers H after completion of the electrodeposition coating in the electrodeposition coating device 45 and transferring them to carriers T, at a predetermined transferring position $P_2$, to a floor conveyor 47 running in a drying furnace 46 in this order.

The floor conveyor 47 constitutes a circulation track 47*a* for conveying the carriers T to which the works W are transferred at a transferring position $P_2$ into the drying furnace 46, conveying the works W after completion of drying to the succeeding step while loading them as they are on the carriers T and returning the carriers T emptied in the succeeding stage again to the transferring position $P_2$.

Further, in the circulation track 47*a* of the floor conveyor 47 that returns from the succeeding step is branched to form a reserved carrier storage track 47*b* for storing the emptied carriers T by the number of the works W being conveyed by the overhead conveyor 42 but not yet conveyed to the drying furnace 46, and the circulation track 47*a* from the exit of the drying furnace 46 to the succeeding step is branched to form a carrier storage track 47*c* for storing all the works W which are being conveyed by the overhead conveyor 42 and the floor conveyor 47 in a state loaded on the carriers T.

Then, the carrier storage track 47*c* is adapted such that, at the instance the conveyance of the works from the preceding step and the conveyance to the succeeding step are stopped, it completes drying for the works W conveying by the floor conveyor 47 and stores them while loading on the carriers T as they are, applies pretreatment and completes electrodeposition coating of the works W conveying by the overhead conveyor 42, transfers them to the carriers T stored in the reserved carrier storage track 47*b,* conveys them successively to the drying furnace 46, completes drying and then stores them while loading as they are on the carriers T.

The overhead conveyor 42 is branched to form a looped empty hanger storage track 41*a* from the circulation track 41 that returns from the transferring position $P_2$ to the loading position $P_1$ for storing hangers H which are emptied after transferring the works to the carriers T of the floor conveyor 47, when the conveyance of the works W from the preceding step is stopped, so that the empty hangers H may be prevented from corrosion caused when left in the pretreatment device 44 or the electrodeposition coating device 45, and so that the empty hangers H can be delivered immediately to the loading position $P_1$ as soon as the conveyance of the works W from the preceding step is started.

With such a constitution, during operation of the conveying lines between each of the steps, the hangers are circulately run by the overhead conveyor 42, pretreatment is applied in the pretreatment device 44 while conveying the works W loaded by the loading device 43, electrodeposition coating is conducted in the electrodeposition coating device 45, the works W are re-transferred subsequently by the transfer device 48 to the carriers T of the floor conveyor 47, and the emptied hangers H are returned again to the loading position $P_1$ to which succeeding works W are loaded and treated continuously.

Then, the floor conveyor 47 is adapted such that empty carriers T returning from the succeeding step along the circulation track 47*a* or the reserved carriers T stored in the reserved carrier storage track 47*b* are conveyed to the transferring position $P_2$, the works W transferred by the transfer device 48 to the carriers T are conveyed into the drying furnace 46 and conveyed as they are to the succeeding step after the completion of the drying.

Then, when the operations for one day are completed, the conveying lines between each of the steps are stopped and conveyance from the preceding step and conveyance to the succeeding step of the works W are stopped, the works W in the drying furnace 46 are stored being loaded as they are on the carriers T in the carrier storage track 47*c,* while the works W in the pretreatment device 44 and the electrodeposition coating device 45 are completed with the pretreatment and the electrodeposition coating, transferred by the transfer device 48 to the reserved carriers T on the floor conveyor 47, dried in the drying furnace 46 and then stored while being loaded as they are on the reserved carriers T in the carrier storage track 47*c,* while the hangers H emptied after transferring the works to the carriers T are stored in the empty hanger storage track 41*a*.

Then, when the conveyance from the preceding step and conveyance to the succeeding step of the works W are started in the next morning, the empty hangers H stored in the empty hanger storage track 41*a* are delivered to the circulation track 41 of the overhead conveyor 42 and caused to stand-by at the loading position $P_1$ and the coating operation is started by successively loading the works W conveyed form the preceding step and at the same time, the works W stored in the carrier storage track 47*c* are successively conveyed together with the carriers T to the succeeding step, and the empty carriers T returned from the succeeding step are delivered to and stored in the reversed carrier storage track 47*b* successively till the leading work W conveyed by the overhead conveyor 42 reaches the transferring position $P_2$.

In accordance with the coating facility described above, even when conveyance from the preceding step and the conveyance to the next step of the works W are stopped, since all the works W that are being conveyed in the overhead conveyor 42 and the floor conveyor 47 can be stored in a state completed with the coating and the drying for the coated film, there is no worry that the works are left during or at the completion of the pretreatment, during or at the completion of the electrodeposition coating and, further, left undried during the drying operation, so that the coating quality can be maintained constant.

However, there are problems in this case for the requirement of additionally providing, in a restricted site of a factory site, a space for storing empty carriers T not used during the running state of applying pretreatment, electrodeposition coating and drying to the works W while conveying them, a space for storing all the works W that are being conveyed by the overhead conveyor 42 and the floor conveyor 47 while loading them on the carriers T at the instance the conveyance from the preceding step and the conveyance to the succeeding step of the works W are stopped, and a space for storing empty hangers.

For instance, assuming that 49 sets of works W are conveyed into the pretreatment device 44 and the electrodeposition coating device 45, while 24 sets of works W are conveyed in the drying furnace 46, and that the storage pitch for the hangers H and the carriers T is about 7 m, the entire length of the empty hanger storage track 41*a* is: 49×7≈350 m, the entire length of the reserved carrier storing track is: 49×7≈350 m and the entire length of the carrier storage track 47*c* is: (49+24)×7≈520 m, so that the total extension of all the storage tracks 41*a,* 47*b* and 47*c* reaches 1200 to 1300 m.

Further, since it is adapted to store all the works W being conveyed in the overhead conveyor 42 and the floor conveyor 47 while loading them to the carriers T, carriers T are required at least by as much as 49+24=73 as the total for the carriers T for conveying the works W in the drying furnace 46 and reserved carriers T for loading the works by the number of them conveyed in the pretreatment device 44 and the electrodeposition device 45.

As described above, since it requires a great amount of carriers T for storing all the works W and a wide storage space, there is a problem of increasing the installation cost.

Further, upon conveying the works W to the succeeding step, the carriers T bring heat in the drying furnace 46 to the outside and are returned being cooled to a room temperature after handing the works W to the succeeding step and they are heated again when entered into the drying furnace 46, so that a great amount of heat in the furnace is lost to result in a problem that a large amount of heat in the drying furnace 46 is consumed to increase the running cost.

In view of the above, it is a technical subject of the present invention to reduce the storing space and the scale of the facility upon storing an identical number of works, thereby improving the space utilization efficiency and decreasing the installation cost, as well as economize the amount of heat consumed in the drying furnace, thereby decreasing the running cost.

DISCLOSURE OF THE INVENTION

In order to solve the subject, the present invention provides a coating facility comprising, along an overhead conveyor formed in a circulation track, a loading device for loading works conveyed from a preceding step at a predetermined loading position to hangers of the overhead conveyor, a pretreatment device for applying pretreatment to the surface of the works loaded by the loading device, a coating device for dipping the works completed with the pretreatment in the pretreatment device into a coating material to deposit the coating material on the surface thereof, and a lifting device for down loading the works from the hangers deposited with the coating material in the coating device and transferring them at a predetermined transferring position to carriers of a floor conveyor that runs in a drying furnace that are arranged in this order, and in which the pretreatment and the coating are applied while the works are conveyed on the overhead conveyor, then the works are transferred to the carries of the floor conveyor, dried during conveyance and then conveyed to a succeeding step after the completion of drying, wherein the floor conveyor is formed in a circulation track that runs in the drying furnace, passes from the exit of the drying furnace through the transferring position and returns to the entrance of the drying furnace, the lifting device is disposed successively along the circulation track of the floor conveyor from the exit of the drying furnace to the transferring position for re-transferring works completed with drying in the drying furnace at a predetermined re-transferring position from the carriers of the floor conveyor to the hangers of the overhead conveyor again, and an unloading device is disposed successively along the circulation track of the overhead conveyor returning from the re-transferring position to the loading position for down loading the works re-transferred to the hangers at a predetermined unloading position from the overhead conveyor and conveying them to a succeeding step, a looped first storage track is disposed for storing works corresponding to a predetermined number of the hangers conveyed on the circulation track of the overhead conveyor in a state suspended from the hangers such that a pull-in side and a delivery side thereof are branched from and joined with the circulation track between the re-transferring position and the unloading position of the overhead conveyor, a second storage track is branched from the circulation track between the exit of the drying furnace of the floor conveyor and the re-transferring position for storing the works in a state loaded to the carriers running on the circulation track of the floor conveyor, and in which pretreatment, coating and drying are completed for all the works during conveyance in the overhead conveyor and the floor conveyor at the instance conveyance from the preceding step and conveyance to the succeeding step of the works are stopped, a predetermined number of leading works are re-transferred to the hangers at the re-transferring position and then stored in the first storage track in a state suspended from the hangers, while the remaining works are delivered out of the drying furnace and then stored in the second storage track in a state loaded on the carriers.

According to the present invention, the works conveyed from the preceding step are loaded to the hangers of the overhead conveyor at a loading position, the works are pretreated at the surface by the pretreatment device and formed with a coating film on the surface thereof by the coating device while being conveyed by the overhead conveyor, transferred to the carriers of the floor conveyor at a transferring position, entered into the drying furnace and dried, re-transferred again at a re-transferring position to the hangers of the overhead conveyor, unloaded each at an unloading position from the hangers and conveyed to the succeeding step.

In this case, the floor conveyor is formed as the circulation track that runs in the drying furnace, passes from the exit of the drying furnace through the re-transferring position and the transferring position and returns to the entrance of the dry furnace, in which the carriers, upon getting out of the drying furnace, pass through the re-transferring position and the transferring position and directly enters into the drying furnace without running to the succeeding step, so that they are caused to run circulately in the drying furnace again before being cooled to a room temperature. Accordingly, the amount of heat in the drying furnace is less deprived by the carriers to decrease the running cost and, since the entire length of the floor conveyor is shortened and number of the carriers is also reduced, the installation cost can be decreased.

Further, when the operation for one day is completed and conveying lines between each of the steps are stopped, after the completion of pretreatment, coating and drying for all the works during conveyance by each of the conveyors, a predetermined number of preceding works are re-transferred to the handers that are conveyed on the circulate track of the overhead conveyor and stored in the first storage track in a state being suspended from the hangers, and the succeeding works are conveyed out of the drying furnace stored in the second storage track while they are loaded as they are on the carriers that runs on the circulation track of the floor conveyor.

In this case, it may suffice that the first and the second storage tracks have such a length as capable of storing all of the works during conveyance in each of the conveyors when the conveying lines between each of the steps are stopped, and it may suffice that there are provided hangers by a predetermined number for pretreatment and coating of the works and carriers by a predetermined number for running in the drying furnace, so that no additional hangers or carriers for storage are required at all, a space for storing empty carriers is saved at all and a space for storing work-loaded carriers is also reduced and the number of the carriers is also reduced remarkably and, accordingly, the space utilization efficiency can be improved remarkably and, at the same time, facilities required for storage can be reduced to decrease the installation cost.

Then, when the conveying lines between each of the steps are operated in the next morning, hangers stored in the first storage track are successively delivered on the circulation track of the overhead conveyor and conveyed to the unloading position, the works are down loaded from the hangers of the overhead conveyor by the unloading device, handed to a conveyor for conveying them to the succeeding step, the emptied hangers are conveyed to the loading position, at least one leading hanger is passed at the loading position, while being emptied as it is, and the works conveyed from the preceding step are successively loaded to the succeeding hangers, and the pretreatment and coating operations are started.

Then, when the empty hanger at the top arrives at the re-transferring position, the carrier T stored in the second storage track is delivered from the delivery side to the circulation track of the floor conveyor, the work loaded on the carrier is re-transferred to the hanger at the re-transferring position, the emptied carrier is sent to the transferring position, the work suspended from the succeeding hanger is transferred to the carrier and entered to the drying furnace, while the emptied hanger is conveyed to the re-transferring position.

In this way, the hanger emptied at the transferring position is sent to the re-transferring position, and the work stored in the second storage track is re-transferred to the hanger at the re-transferring position and subsequently, the works delivered out of the drying furnace are re-transferred to the hangers and conveyed to the unloading position, the emptied hangers are conveyed again to the loading position, and the works conveyed from the preceding step are loaded, and then the coating operation is continued.

BEST MODE FOR PRACTICING THE INVENTION

The mode for practicing the present invention will be explained next specifically based on the drawings.

Figure 1:
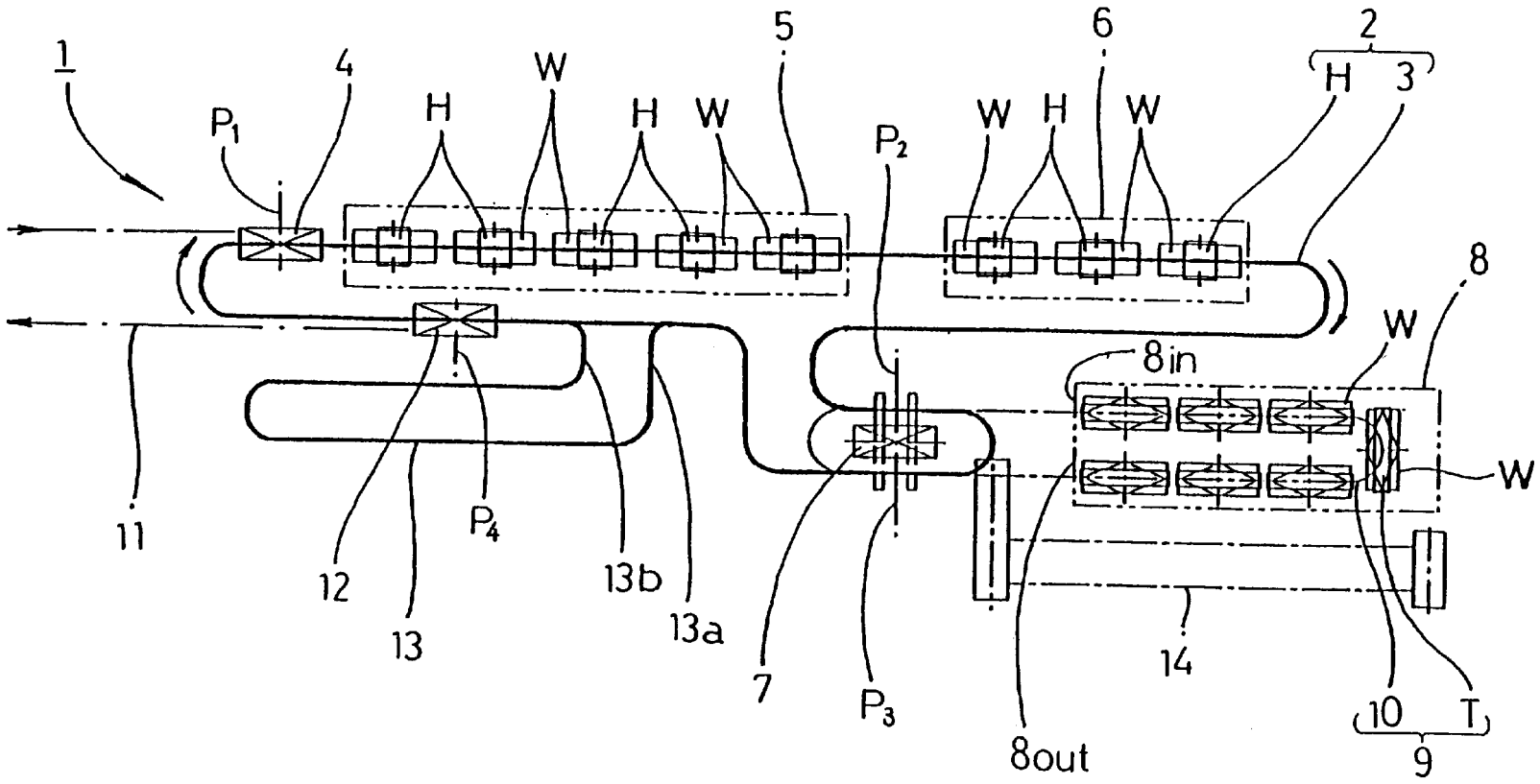
FIG. 1 is a plan view showing a running state of a coating facility according to the present invention.
Figure 2:
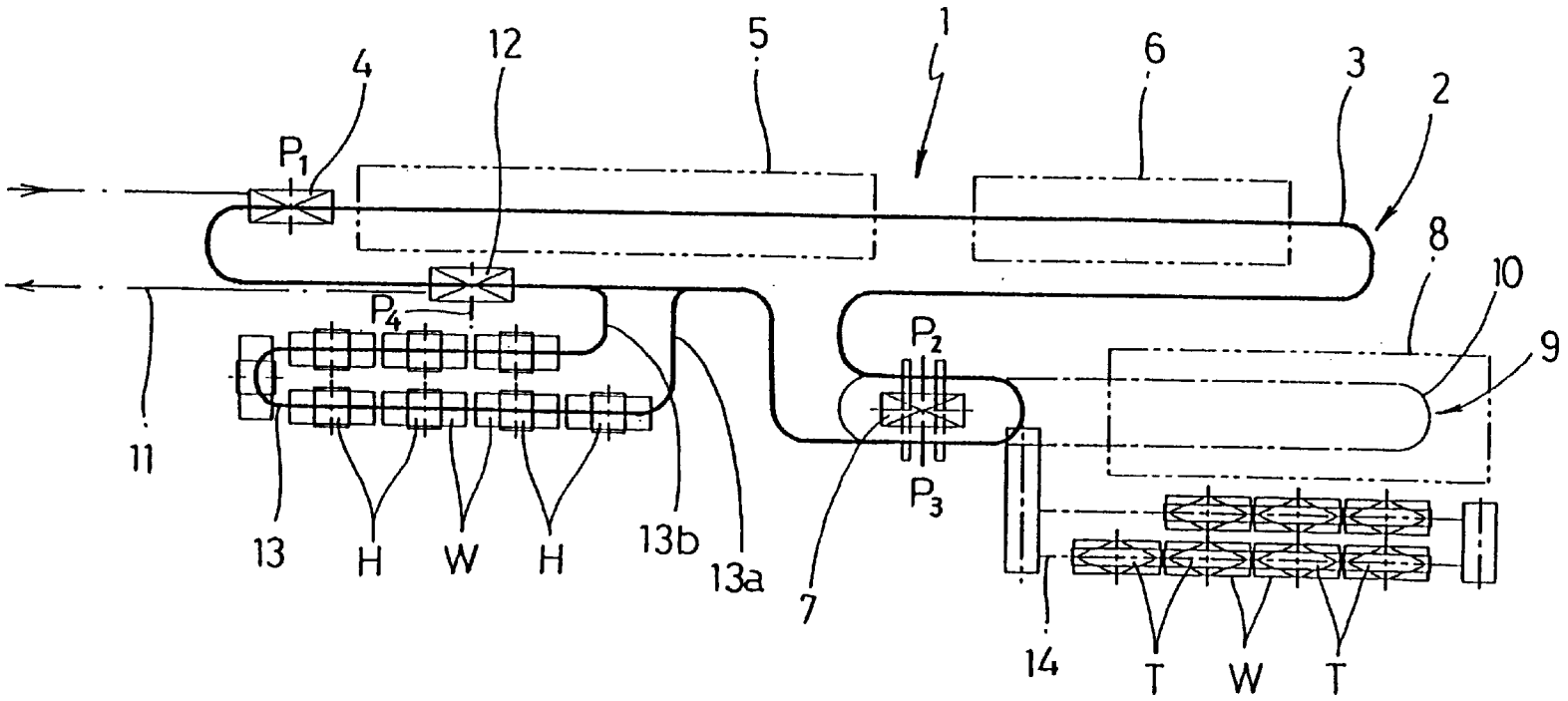
FIG. 2 is a plan view showing a storage state thereof.

A coating facility 1 shown in FIG. 1 and FIG. 2 has an overhead conveyor 2 formed in a circulation track 3 for conveying works W while suspending them upstairs by hangers H, in which are arranged, along the overhead conveyor 2, a loading device 4 for loading the works W conveyed from a preceding step to hangers H each at a loading position $P_1$, a pretreatment device 5 for applying pretreatment such as cleaning, degreasing and chemical formation to the surface of the works W loaded by the loading device 4, an electrodeposition coating device 6 for forming an electrodeposition coating film on the surface of the works W downstairs after completion of the pretreatment in the pretreatment device 5 and a lifting device 7 for descending the works W after completion of electrodeposition coating by the electrodeposition coating device 6 each at a transferring position $P_2$.

In the downstairs, a floor conveyor 9 for running carriers T for loading works W at a predetermined interval is formed in a circulation track 10 that runs in the drying furnace 8, goes from the exit 8out of the drying furnace, around the periphery of the lifting device 7 and returns to the entrance 8in of the drying furnace. The lifting device 7 has a transferring position $P_2$ at the front and is adapted to down load the works W after completion of the electrodeposition coating by the electrodeposition coating device 6 from the hangers H of the overhead conveyor 2 in the upstairs and re-transfer them to the carriers T in the floor conveyor 9 laid in the downstairs, lift up the works W after completion of the drying in the drying furnace 8 from the carriers T on the floor conveyor 9 in the downstairs and re-transfer them on the hangers H of the overhead conveyor 2 in the upstairs each at a re-transferring position $P_3$ at the back thereof.

The circulation track 3 for the overhead conveyor 2 is formed so as to pass the transferring position $P_2$ and the re-transferring position $P_3$, while going around the periphery of the lifting device 7 and return to the loading position $P_1$, and an unloading device 12 is disposed between the re-transferring position $P_3$ and the loading position $P_1$ for descending the works W re-transferred to the hangers H each at the re-transferring position $P_3$ from the overhead conveyor 2 at a predetermined unloading position $P_4$ and handing them to a conveyor 11 for conveying them to the succeeding step.

A looped first storage track 13 formed to such a length as capable of storing the works W, each in a state being suspended from the hangers H, by a predetermined number (for example 49) of the hangers H to be conveyed on the circulation track 3 for the overhead conveyor 2 is laid such that a pull-in side 13*a* and a delivery side 13*b* thereof are branched from and joined with the circulation track 3 between the re-transferring position $P_3$ and the unloading position $P_4$ of the overhead conveyor 2.

Further, a second storage track 14 formed to such a length as capable of storing carriers T running on the circulation track 10 for the floor conveyor 9 in a state of loading the works W by a predetermined number (for example, 24) is formed while being branched from the circulation track 10 at a predetermined position between the exit 8out of the drying furnace and the re-transferring position $P_3$.

An embodiment of the constitution of the present invention is as described above, and the function will be explained next.

Explanations will be made, for example, to a case where the number of the hangers H conveyed on the circulation track 3 for the overhead conveyor 2 is 49, the number of the carriers T running on the circulation track 10 for the floor conveyor 9 is 24 and the storage pitch is about 7 m.

At first, FIG. 1 shows a running state where the conveying lines between each of the steps in a factory are in operation, in which the surface of the works W is pretreated in the pretreatment device 5 and an electrodeposition film is formed on the surface of the works W in the electrodeposition device 6 while the works W loaded to the hangers H of the overhead conveyor 2 each at the loading position $P_1$ are conveyed in the upstairs during the conveyance of the works W from a preceding step and to the succeeding step.

Then, upon reaching the transferring position $P_2$, the works W are down loaded from the hangers H of the overhead conveyor 2 by the lifting device 7, transferred to the carriers T of the floor conveyor 9 in the upstairs, entered into and dried in the dry furnace 8, then conveyed out of the drying furnace and lifted up by the lifting device 7 at the re-transferring position $P_3$, and re-transferred again to the hangers H of the overhead conveyor 2, then conveyed to the unloading position $P_4$, unloaded from the overhead conveyor 2 by the unloading device 12 and handed to the conveyor 11 for conveying them to the succeeding step.

In this case, the floor conveyor 9 is formed as the circulation track 10 that runs in the drying furnace 8, goes from the exit 8out of the drying furnace around the lifting device 7 and immediately returns to the entrance 8in of the drying furnace, and the carriers T run almost in the drying furnace 8 and conveyed out of the drying furnace only for transferring/re-transferring the works W relative to the overhead conveyor 2, and the carriers T are not run to the succeeding step and the circulation track 10 laid outside the drying furnace 8 can be shortened, so that the carriers T run inside the drying furnace 8 again before being cooled to a room temperature. Accordingly, since the amount of heat in the drying furnace to be deprived by the carriers T can be reduced, the running cost can be saved, and since the number of the carriers T may be suffice by the number for running a short circulation track 10 of the floor conveyor 9, the installation cost can also be decreased.

Then, FIG. 2 shows a storage state when the operation for one day is completed and the conveying lines between each of the steps are stopped. When the conveyance from the preceding step and conveyance to the succeeding step are stopped, all the works W conveyed by each of the conveyors 2 and 9 are stored on the first and the second storage tracks 13 and 14, after completion of drying for those under drying in the drying furnace 8, after transfer to the carriers T of the floor conveyor 9 each at the transferring position $P_2$ and completion of drying in the drying furnace 8 for those during electrodeposition coating in the electrodeposition coating device 6, and after completion of the electrodeposition coating by the electrodeposition coating device 6, transfer to the carriers T of the floor conveyor 9 each at the transferring position $P_2$ and completion of drying in the drying furnace 8 for those during pretreatment in the pretreatment device 5.

In this case, among the total 73 works conveyed by the floor conveyor 9 and the overhead conveyor 2, preceding 49 works W after completion of drying are successively re-transferred to the hangers H of the overhead conveyor each at the re-transferring position $P_3$ and entered from the pull-in side 13*a* in a state being suspended from the hangers H and stored therein.

Then, 24 works W succeeding to the works W stored in the first storage track 13 are conveyed from the drying furnace 8 in a state being placed on the carriers T, sent as they are to the second storage track 14 and stored therein.

In this case, assuming the length of the storage pitch as about 7 m, the first storage track 13 requires the distance of 49×7 m≈350 m for storing the 49 works W, and the second storage track requires the distance of 24×7 m≈170 m for storing 24 works W. Accordingly, it may suffice to ensure about 520 m for the total extension, and the space for storing empty carriers required for storage when the entire works W are loaded on the carriers is not necessary at all, and since the space for storing the carriers in a state of loading the works is reduced, the total extension of the storage track is about ½ of that in the existent coating facility, thereby enabling to remarkably improve the space utilization efficiency.

It is necessary for the hangers H by the number of 49 and the carriers T by the number of 24, but since they are the minimum number that has to be used for pretreatment, electrodeposition coating and drying of the works W, it is not necessary to provide additional hangers and carriers for storing the works, thereby enabling to decrease the installation cost.

In the next morning, when the conveying lines between each of the steps are operated, the hangers H stored in the first storage track 13 are successively delivered to the circulation track 3 of the overhead conveyor 2 and conveyed to the unloading position $P_4$, and the works W are unloaded from the hangers H of the overhead conveyor 2 each at the unloading device $P_4$ and handed to the conveyor 11 for conveying them to the succeeding step, while the emptied hangers H are conveyed to the loading position $P_1$.

At the loading position P1, at least only one empty hanger H at the top is passed as it is and the works W conveyed from the preceding step are successively loaded to the succeeding hangers H, and the pretreatment and coating operations are started.

Subsequently, when the empty hanger at the top arrives at the re-transferring position $P_3$, the carrier T stored in the second storage track 14 is delivered to the circulating track 10 for the floor conveyor 9, the work W loaded on the carrier T is re-transferred to the hanger H at the re-transferring position $P_3$ then the emptied carrier T is sent to the transferring position $P_2$ then the work W suspended on the succeeding hanger H is transferred successively to the carrier T and entered into the drying furnace 8, while the emptied hanger H is conveyed to the re-transferring position $P_3$.

In this way, the hangers. H emptied at the transferring position $P_2$ are sent to the re-transferring position $P_3$, the works W stored in the second storage track 14 are re-transferred to the hangers H each at the re-transferring position $P_3$, the works W conveyed out of the drying furnace 8 are subsequently re-transferred to the hangers H and sent to the unloading position $P_4$, while the emptied hangers H are conveyed again to the loading position $P_1$, and the works W conveyed from the preceding step are loaded and then the coating operation is continued.

According to this embodiment, as decreased above, since the works W are stored in a state being suspended from the hangers H sent in the circulation track 3 for the overhead conveyor 2 and being placed on the carriers T running on the circulation track 10 for the floor conveyor 9, since not only the space can be saved by so much and the space for storing empty carriers is not necessary at all, but also the space for storing the carriers T loading the works W is also reduced and since the number of required carriers can be reduced remarkably, the space utilizing efficiently can be improved outstandingly and, at the same time, equipments required for the storage can also be reduced to decrease the installation cost.

In addition, since the carriers T of the floor conveyor 9, after getting out of the drying furnace 8, enter immediately into the drying furnace 8 passing around the lifting device 7 without running to the succeeding step, the carriers T run into the drying furnace 8 again before being cooled to a room temperature. Accordingly, the amount of heat in the drying furnace 8 to be deprived by the carriers T is reduced to decrease the running cost and, at the same time, since it may suffice to provide the carriers T by the number for running on the floor conveyor 9, the installation cost can be decreased.

Explanations have been made to the coating facility of using the electrodeposition coating device as the coating device, but the present invention is not limited thereto and, for example, a coating device for conducting dip coating can also be used.

In addition, in this embodiment, explanations have been made to the case of using one lifting device 7 in which the works W are transferred from the hangers H of the overhead conveyor 2 to the carriers T on the floor conveyor 9 each at the transferring position $P_2$ at the front thereof, and re-transferred from the carriers T, to the hangers H at the re-transferring position $P_3$ at the back, but the present invention is not limited thereto, and separate lifting devices can also be used at respective positions.

Another Mode for Practicing the Present Invention

Figure 3:
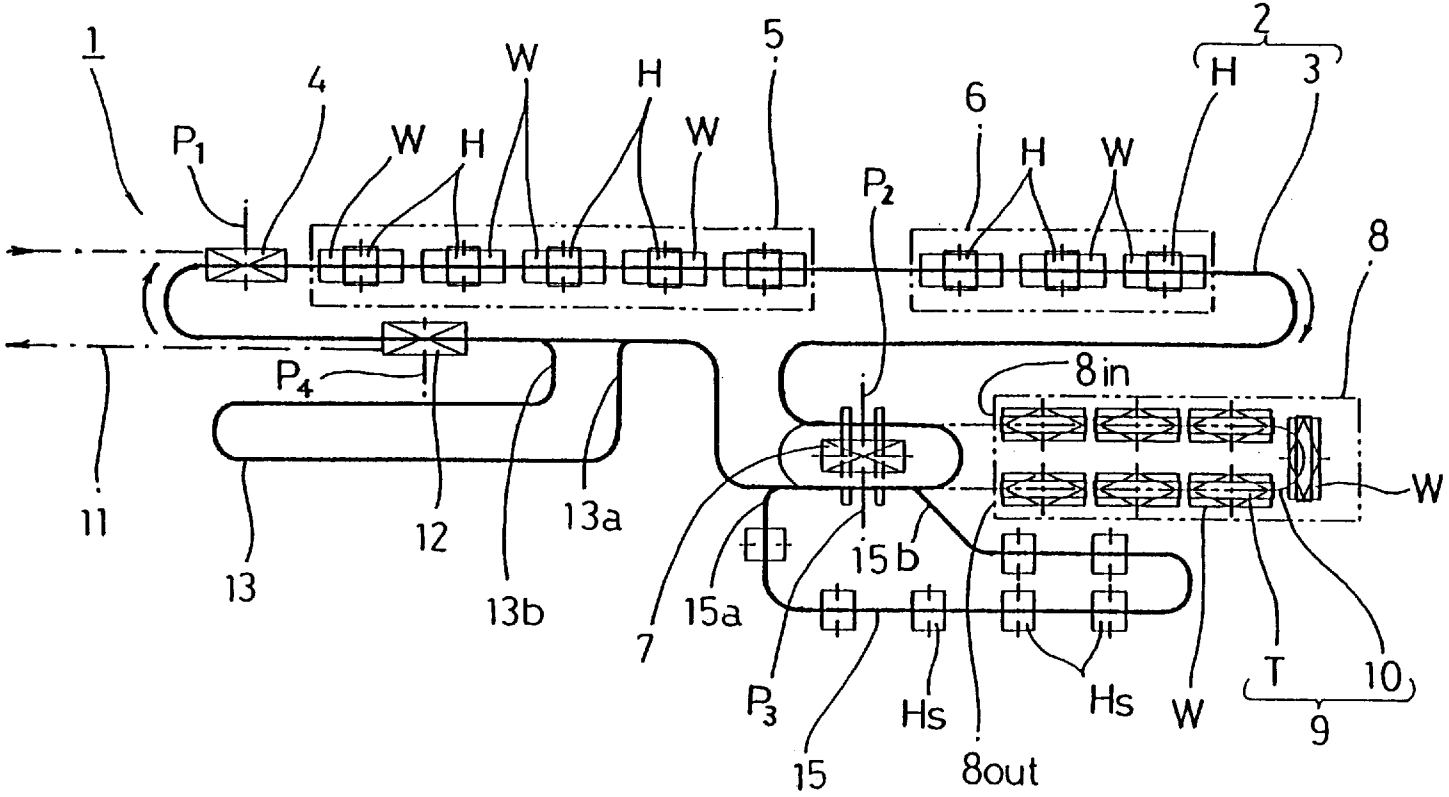
FIG. 3 is a plan view showing a running state of another embodiment according to the present invention.
Figure 4:
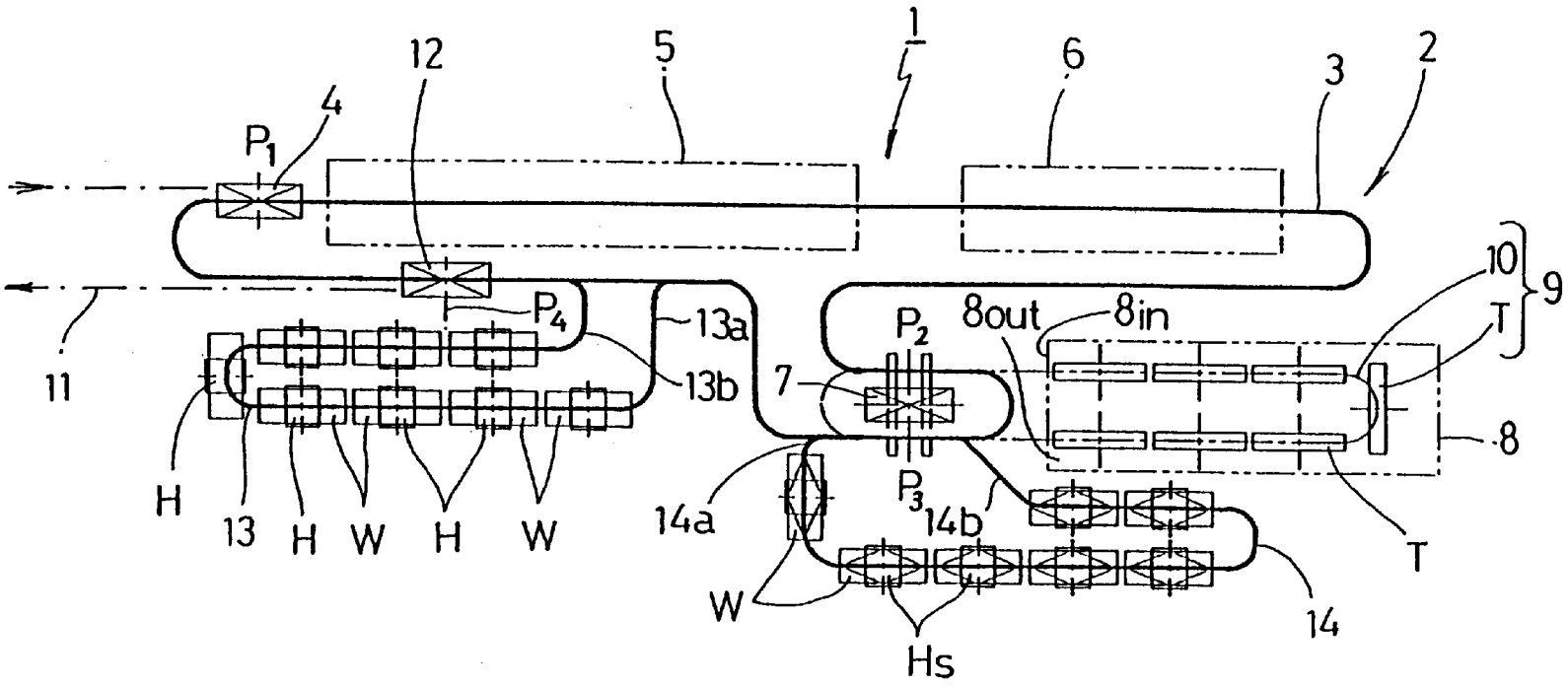
FIG. 4 is a plan view showing a storage state thereof.
Figure 5:
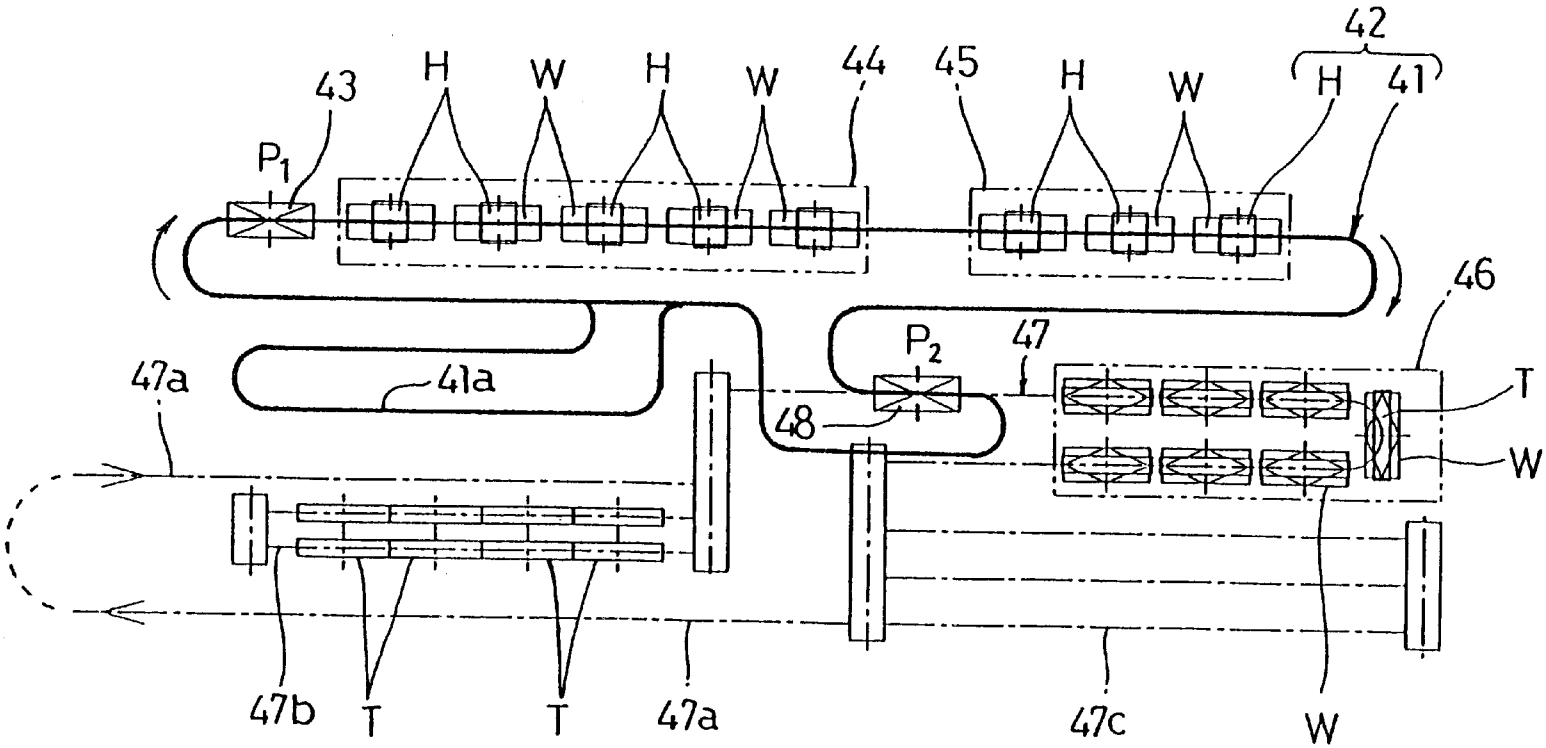
FIG. 5 (PRIOR ART)
FIG. 5 is a plan view showing a running state of an prior art apparatus and FIG. 6 is a plan view showing a storage state of the prior art.
Figure 6:
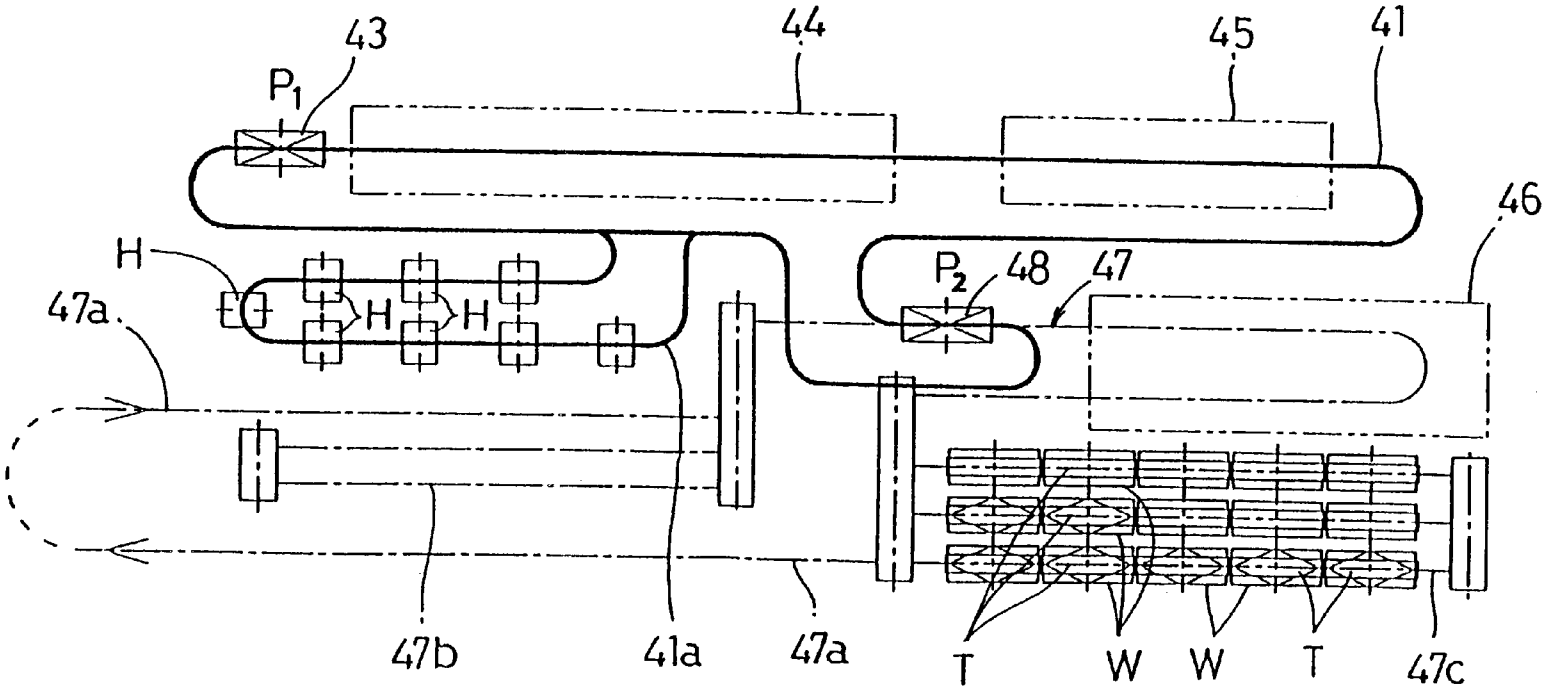
FIG. 6 (PRIOR ART)

FIG. 3 is a plan view showing a running state of another embodiment according to the present invention, and FIG. 4 is a plan view showing a storage state. Identical portions with those in FIGS. 1 and 2 carry same references, with detailed explanations being omitted.

According to this embodiment, a second storage track 15 is formed in a looped-shape, in which a pull-in side 15*a* is branched from a circulation track 3 between a re-transferring position $P_3$ and an unloading position $P_4$ of an overhead conveyor 2 and a delivery side 15*b* is joined with the circulation track 3 before the re-transferring position $P_3$ of the overhead conveyor 2.

The second storage track 15 has reserved hangers Hs by the number (for example 24) of the carriers T of the floor conveyor 9 and is determined to such a length as capable of storing the works W in a state they are suspended from the reserved hangers Hs.

When the operation for one day is completed, preceding 49 sets of works W after completion of drying are successively re-transferred to the hangers H of the overhead conveyors 2 at the re-transferring position $P_3$ and entered from the pull-in side 13*a* in a state being suspended from the hangers H and stored in a first storage track 13.

In addition, succeeding 24 sets of works W after completion of drying are re-transferred to the reserved hangers Hs delivered from the delivery side 15*b* thereof to the re-transferring position $P_3$ of the circulation track 3 and entered from the pull-in side 15*a* in a state being suspended from the reserved hangers Hs and stored in the second storage track 15.

Then, when the conveying lines between each of the steps are operated in the next morning, the works W stored in the first storage track 13 are handed to the conveyor 11 at the unloading position $P_4$ and conveyed to the succeeding step, and then the hangers H stored in the second storage track 15 are successively delivered from the delivery side 15*b* to the circulation track 3 for the overhead conveyor 2 and the hangers H are sent to the unloading position $P_4$ directly or by way of the first storage track 13 to unload the works W, and then sent to the loading position $P_1$.

When the hanger H at the top arrives at the loading position $P_1$, the work W conveyed from the preceding step is successively loaded at the loading position $P_1$, and pretreatment and coating operations are started.

Then, after transfer to the carriers T of the floor conveyor 9 at the transferring position $P_2$, the emptied handers H are successively sent to the second storage track 15, and the empty hangers H by the number for the reserved hangers Hs are stored as reserved hangers Hs and succeeding hangers H, after transfer to the carriers T of the floor conveyor 9 at the transferring position $P_2$, are re-transferred with the works W conveyed from the drying furnace 8 each at the re-transferring position $P_3$, and then conveyed to the unloading position $P_4$, and further conveyed to the loading position $P_1$ to load the works conveyed from the preceding step, and the coating operation is continued.

Also in this embodiment, since the works W are stored in a state where they are suspended from the hangers H, not only the space can be saved by so much, but also the space for storing the empty carriers and the space for storing the work-loaded carriers are not necessary at all, and since the number of the carries is greatly reduced, the space utilization efficiency can be improved outstandingly and, at the same time, equipments required for the storage can be reduced to decrease the installation cost.

In accordance with the same conditions as those for the coating facility shown in FIG. 1 and FIG. 1 in this case, it may suffice to keep a total extension of 520 m for the first and the second storage tracks 13 and 15.

Further, while this requires the hangers H by the number of 49 and the reserved hangers Hs by the number of 24, since the hangers H by the number of 49 are used for the pretreatment and electrodeposition coating of the works W, the number of the hangers increased for the storage is only 24 for the reserved hangers Hs. Further, it may suffice to provide the carriers T by the number of 24 required for drying the works W and, although the number of the hangers is increased by 24 compared with a coating facility of storing all the works W being placed on the carriers, since the number of the carriers is decreased by 49, the installation cost is decreased as a whole.

Further, the storage tracks 13 and 15 are not restricted to a case of forming them to separate loops but it may be applicable also to a case, for example, of making the pull-in side 13*a* and 15*a* in common, branching the track at the midway and joining the delivery side 13*a* and 15*b* separately to the circulation track 3 for the overhead conveyor respectively thereby making a portion thereof to be in common.

Industrial Field of Application

As has been described above, according to the present invention, since the space for storing the empty carriers is saved upon storing an identical number of works, to reduce the space for storing the work-loaded carriers and the number of required carries is greatly decreased, the space utilizing efficiency can be improved outstandingly and, at the same time, equipments required for storage can be reduced to decrease the installation cost, as well as since the floor conveyor is formed such that carriers running in the drying furnace are returned immediately into the drying furnace without conveying the works as far as the succeeding step, it provides an excellent effect capable of economizing the amount of heat consumption in the drying furnace to decrease the running cost.

Accordingly, it is suitable to be used for a coating facility, such as a coating facility for car bodies adapted to conduct pretreatment, coating and drying while conveying works and send them to the succeeding step after the completion of drying, in which works during pretreatment, coating, drying are processed as far as drying when the conveying lines between each of the steps are stopped after the completion for one day's operation, and stored in a state completed with drying.

What is claimed is:

1. A coating facility comprising, along an overhead conveyor formed in a circulation track, a loading device for loading works W conveyed from a preceding step at a predetermined loading position to hangers of the overhead conveyor, a pretreatment device for applying pretreatment to surfaces of the works W loaded by the loading device, a coating device for dipping the pretreated works W into a coating material to deposit the coating material on the surfaces thereof, and a lifting device for down loading the coated works W from the hangers and transferring them at a predetermined transferring position $P_2$ to carriers of a floor conveyor that runs in a drying furnace in this order, and in which the pretreatment and the coating are applied while the works W are conveyed on the overhead conveyor, then the works are transferred to the carriers of the floor conveyor, dried during conveyance and then conveyed to a succeeding step after the completion of drying, wherein the floor conveyor is formed in a circulation track that runs in the drying furnace, passes from an exit of the drying furnace through the transferring position $P_2$ and returns to an entrance of the drying furnace, the lifting device is disposed successively along the circulation track of the floor conveyor between the exit of the drying furnace and the transferring position $P_2$ for re-transferring dried works W from the drying furnace at a predetermined re-transferring position $P_3$ from the carriers of the floor conveyor to the hangers of the overhead conveyor again, and an unloading device is disposed successively along the circulation track of the overhead conveyor between the re-transferring position $P_3$ and the loading position $P_1$ for down loading the re-transferred works W from the overhead conveyor at a predetermined unloading position $P_4$ and conveying them to a succeeding step, a looped first storage track is disposed for storing works W corresponding to a predetermined number of the hangers conveyed on the overhead conveyor circulation track in a state suspended from the hangers such that a pull-in side and a delivery side thereof are branched from and joined with the overhead conveyor circulation track between the re-transferring position $P_3$ and the unloading position $P_4$, a second storage track is branched from the circulation track between the exit of the drying furnace of the floor conveyor and the re-transferring position $P_3$ for storing the works W in a state loaded to the carriers running on the floor conveyor circulation track, and in which pretreatment, coating and drying are completed for all the works W through conveyance in the overhead conveyor and the floor conveyor at the instance conveyance from the preceding step and conveyance to the succeeding step of the works W are stopped, a predetermined number of dried works W are re-transferred to the hangers at the re-transferring position $P_3$ and then stored in the first storage track in a state suspended from the hangers, while the remaining works W are delivered out of the drying furnace and then stored in the second storage track in a state loaded on the carriers.

2. A coating facility comprising, along an overhead conveyor formed in a circulation track, a loading device for loading works W conveyed from a preceding step at a predetermined loading position $P_1$ to hangers of the overhead conveyor, a pretreatment device for applying pretreatment to surfaces of the works W loaded by the loading device, a coating device for dipping the pretreated works W into a coating material to deposit the coating material on the surfaces thereof, and a lifting device for down loading the coated works W from the hangers and transferring them at a predetermined transferring position $P_2$ to carriers of a floor conveyor that runs in a drying furnace in this order, and in which the pretreatment and the coating are applied while the works W are conveyed on the overhead conveyor, then the works are transferred to the carriers of the floor conveyor, dried during conveyance and then conveyed to a succeeding step after the completion of drying, wherein the floor conveyor is formed in a circulation track that runs in the drying furnace, passes from an exit of the drying furnace through the transferring position $P_2$ and returns to an entrance of the drying furnace, the lifting device is disposed successively along the circulation track of the floor conveyor between the exit of the drying furnace and the transferring position $P_2$ for re-transferring dried works W from the drying furnace at a predetermined re-transferring position $P_3$ from the carriers of the floor conveyor to the hangers of the overhead conveyor again, and an unloading device is disposed successively along the circulation track of the overhead conveyor between the re-transferring position $P_3$ and the loading position $P_1$ for down loading the re-transferred works W from the overhead conveyor at a predetermined unloading position $P_4$ and conveying them to a succeeding step, a looped first storage track is disposed for storing works W corresponding to a predetermined number of the hangers conveyed on the overhead conveyor circulation track in a state suspended from the hangers such that a pull-in side and a delivery side thereof are branched from and joined with the overhead conveyor circulation track between the re-transferring position $P_3$ and the unloading position $P_4$, a looped second storage track having reserved hangers for a predetermined number of the carriers running along the floor conveyor circulation track for storing the works W in a state suspended from the reserved hangers is laid such that a pull-in side thereof is branched from the circulation track between the re-transferring position $P_3$ and the unloading position $P_4$ and a delivery side thereof is joined to the circulation track before the re-transferring position $P_3$, and in which pretreatment, coating and drying are completed for all the works W through conveyance in the overhead conveyor and the floor conveyor at the instance conveyance from the preceding step and conveyance to the succeeding step of the works W are stopped, a predetermined number of dried works W are re-transferred to the hangers at the re-transferring position $P_3$ and then stored in the first storage track in a state suspended from the hangers, while the remaining works W are re-transferred to the reserved hangers and then stored in the second storage track in a state suspended from the reserved hangers.

* * * * *